US008958738B2

(12) United States Patent
Yamana

(10) Patent No.: US 8,958,738 B2
(45) Date of Patent: Feb. 17, 2015

(54) CLEANING APPARATUS AND IMAGE FORMING APPARATUS

(71) Applicant: Canon Kabushiki Kaisha, Tokyo (JP)

(72) Inventor: Kentarou Yamana, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/856,523

(22) Filed: Apr. 4, 2013

(65) Prior Publication Data

US 2013/0287428 A1 Oct. 31, 2013

(30) Foreign Application Priority Data

Apr. 25, 2012 (JP) ..... 2012-100344

(51) Int. Cl.
*G03G 15/16* (2006.01)
*G03G 21/00* (2006.01)

(52) U.S. Cl.
CPC ..... *G03G 21/0035* (2013.01)
USPC ..... 399/354; 399/101

(58) Field of Classification Search
CPC ..... G03G 21/007; G03G 21/0047; G03G 21/0035
USPC ..... 399/101, 354, 353
See application file for complete search history.

(56) References Cited

U.S. PATENT DOCUMENTS 5,999,791 A 12/1999 Ogawa et al.
8,041,281 B2 * 10/2011 Sugimoto et al. ..... 399/354

FOREIGN PATENT DOCUMENTS

JP 11-73080 A 3/1999
JP 2002-207403 A 7/2002
JP 2010-170020 A 8/2010

* cited by examiner

*Primary Examiner* — Erika J Villaluna
(74) *Attorney, Agent, or Firm* — Fitzpatrick, Cella, Harper & Scinto

(57) ABSTRACT

A cleaning apparatus restrains the scattering of toners in an intermediate transfer member cleaning apparatus thereby to restrain the scattering toners from dirtying the inside of the apparatus. A cleaning container has an anti-scatter portion that enters into a fur brush. The anti-scatter portion blocks a bias roller from a space outside the cleaning apparatus.

15 Claims, 6 Drawing Sheets

CLEANING APPARATUS AND IMAGE FORMING APPARATUS

BACKGROUND OF THE INVENTION

1. Field of the Invention

The present invention relates generally to an electrophotographic type image forming apparatus, such as a copying machine or a printer, and more particularly, to a cleaning apparatus adapted to clean off toner in an image forming apparatus by an electrostatic fur brush.

2. Description of the Related Art

Hitherto, there has been a tandem type color electrophotographic image forming apparatus adapted to primarily transfer a toner image formed on a photosensitive drum, which is a first image bearing member, to an intermediate transfer member in sequence, and then secondarily transfer a toner image, which is a superimposed color image, onto a recording medium.

In this type of color electrophotographic image forming apparatus, the transfer residual toner remaining on an intermediate transfer belt 31, which is an intermediate transfer member, after the secondary transfer is removed by a cleaning apparatus 95 for the intermediate transfer belt 31, as illustrated in FIG. 7A. Thus, the surface of the intermediate transfer belt is cleaned to prepare for the next image transfer. The cleaning apparatus 95 is a cleaning apparatus which has a cleaning blade 107 to scrape off the transfer residual toner from the surface of the intermediate transfer belt 31.

However, it has been impossible to accomplish adequate cleaning off of the toner on a second image bearing member, such as an intermediate transfer belt, by merely mechanically scraping off the toner by the cleaning apparatus. There has been a method, in which a bias having the polarity opposite from the polarity of a toner is applied to a fur brush 90 illustrated in FIG. 7B thereby to electrostatically adsorb the residual toner. However, toners of various charging characteristics remain on the intermediate transfer belt 31, so that it has been difficult to clean all of them by the aforesaid method.

A configuration of a cleaning apparatus for an intermediate transfer belt has been proposed in Japanese Patent Application Laid-Open No. 2002-207403, in which two fur brushes are provided and biases of different polarities are applied thereto. More specifically, as illustrated in FIG. 6, according to an intermediate transfer member cleaning apparatus 36A, each of two fur brushes 90 and 91 is subjected to a different bias so as to cause toners having various charging properties to adsorb to the brushes 90 and 91, respectively, thereby removing the toners from an intermediate transfer belt 31. Referring to FIG. 6, S denotes the outflow path of scattering toners.

As described above, the configuration according to Japanese Patent Application Laid-Open No. 2002-207403 is capable of providing satisfactory cleaning performance. However, as compared with the configuration in which toners are mechanically removed by a blade or the like, the scattering toners tend to flow out toward the downstream side in the moving direction of the intermediate transfer belt 31, as indicated by the dashed arrow. This is because the air flow caused by the rotations of the intermediate transfer belt 31 and the fur brush 91 inconveniently scatters the toners into a space L out from the cleaning apparatus 36A. Further, the toners are also scattered out of the cleaning apparatus 36A due to a decreased outer diameter of the fur brush 91 as the fur brush 91 wears off with time. This leads to defective images or the like attributable to a dirty interior of the apparatus.

The above description relates to an intermediate transfer member carrying toners. The same problem as that described above also applies to a cleaning apparatus for an image bearing member, such as a photosensitive drum carrying toners in the same manner.

SUMMARY OF THE INVENTION

Accordingly, an object of the present invention is to provide a cleaning apparatus and an image forming apparatus capable of restraining the scattering of toners in the cleaning apparatus, which removes toners from an image bearing member, thereby restraining the scattering toners from dirtying the inside of the apparatuses so as to prevent the dirt from causing deteriorated images.

A cleaning apparatus in accordance with the present invention has: a fur brush configured to contact with an image bearing member at a first contact position and electrostatically collect a toner on the image bearing member, and to rotate in an opposite direction with respect to the moving direction of the image bearing member at the first contact position; a bias roller configured to enter into the fur brush at a second contact position, and electrostatically collect the toner on the fur brush, and to rotate in the same direction with respect to the moving direction of the fur brush at the second contact position; and a cleaning container configured to support the fur brush and the bias roller, and to have an anti-scatter portion, which enters into the fur brush so as to shield the bias roller from the outside of the cleaning apparatus.

According to the present invention, the anti-scatter portion blocks the outflow path, along which scattering toners in the cleaning apparatus would flow out into the space outside the cleaning apparatus, thus making it possible to prevent the scattering toners from dirtying the inside of the apparatus. A fur brush normally wears off as the apparatus running time elapses and the outer diameter thereof decreases accordingly. However, the anti-scatter portion enters into a rotating fur brush to raise the hair of the fur brush so as to reduce a change in the outer diameter, thus making it possible to restrain the deterioration of the cleaning performance.

Further features of the present invention will become apparent from the following description of exemplary embodiments with reference to the attached drawings.

BRIEF DESCRIPTION OF THE DRAWINGS

FIG. 3A is a diagram illustrating the amount of entry of the anti-scatter portion into a fur brush, the amount of entry of a bias roller into the fur brush, and the positions thereof; and FIG. 3B illustrates the amount of the entry of the anti-scatter portion into the fur brush.

FIG. 4A illustrates an example in which the anti-scatter portion is configured to be detachable with respect to a cleaning container of the cleaning apparatus; and FIG. 4B illustrates an example in which the anti-scatter portion is formed of a sheet member.

FIG. 7A illustrates an example of a configuration using a cleaning blade; and FIG. 7B illustrates an example of a configuration using a fur brush.

DESCRIPTION OF THE EMBODIMENTS

Preferred embodiments of a cleaning apparatus and an image forming apparatus according to the present invention will now be described in detail in accordance with the accompanying drawings.

Embodiment 1

A cleaning apparatus and an image forming apparatus in accordance with the present invention will be described with reference to FIGS. 1 to 5; however, it is to be understood that the invention is not limited to the disclosed exemplary embodiments.

Figure 1:
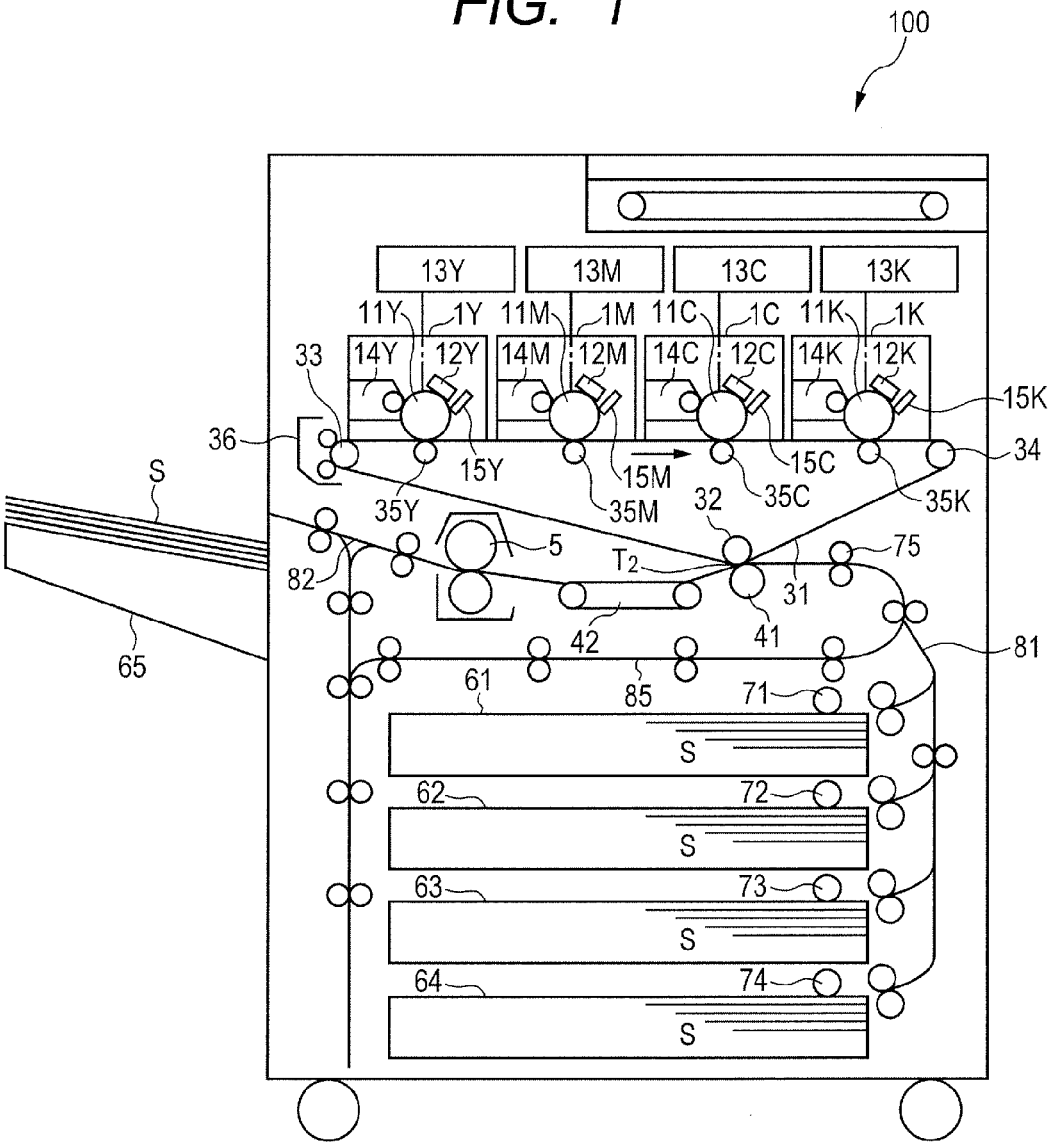
FIG. 1 is a schematic general configuration diagram illustrating an embodiment of an image forming apparatus in accordance with the present invention.

FIG. 1 is a schematic configuration sectional view illustrating an embodiment of the image forming apparatus in accordance with the present invention.

An image forming apparatus 100 in the present exemplary embodiment is a tandem type intermediate transfer type image forming apparatus in which image forming units 1Y, 1M, 1C and 1K are disposed in series on a horizontal section of a belt-shaped intermediate transfer member, namely, an intermediate transfer belt 31. A full color image is electrophotographically formed on a sheet material S according to image signals transmitted from an external device.

The image forming units 1Y, 1M, 1C and 1K are provided with drum-shaped electrophotographic photosensitive members (hereinafter referred to as the photosensitive drums) 11 (11Y, 11M, 11C and 11K), which are first image bearing members. The surfaces of the photosensitive drums 11 are uniformly charged by charging units 12 (12Y, 12M, 12C and 12K). The surfaces of the photosensitive drums 11 after being charged (the first image bearing members) are exposed by exposure units 13 (13Y, 13M, 13C and 13K) according to image signals thereby to form an electrostatic latent image. The formed electrostatic latent image is developed into toner images of the individual colors by developing units 14 (14Y, 14M, 14C and 14K), which apply corresponding developers, i.e., toners, of Y (yellow), M (magenta), C (cyan) and K (black), to the latent image.

The intermediate transfer belt 31, which is a second image bearing member, is laid across in a tensioned state and rotated by a drive roller 33, a tension roller 34, and a secondary transfer opposing roller 32 for carrying out secondary transfer. Primary transfer rollers 35 (35Y, 35M, 35C and 35K), which are primary transfer elements for carrying out the primary transfer to the positions opposing the photosensitive drums 11 (11Y, 11M, 11C and 11K), are disposed on the inner peripheral surface side of the intermediate transfer belt 31.

The individual yellow, magenta, cyan, and black color toner images is primarily transferred in sequence to the same image position on the intermediate transfer belt 31 (on the intermediate transfer member) by primary transfer rollers 35 (35Y, 35M, 35C and 35K).

The toners remaining on the photosensitive drums 11 after the primary transfer of the toner images are removed by photosensitive cleaning apparatuses 15 (15Y, 15M, 15C and 15K) disposed around the photosensitive drums 11. Meanwhile, the sheet material S stored in a paper cassette 61, 62, 63 or 64 is carried to a paper feed path 81 by the rotation of one of paper feed rollers 71, 72, 73 and 74.

Subsequently, a resist roller 75 feeds the sheet material S, which is a recording medium, to a secondary transfer section $T_2$, which is formed by the contact between a secondary transfer roller 41 and the secondary transfer opposing roller 32, in a synchronized timing with the toner images on the intermediate transfer belt 31. The toner image formed on the intermediate transfer belt 31 is transferred onto the sheet material S at the secondary transfer section $T_2$.

Subsequently, the sheet material S onto which the toner image has been transferred is carried to a heat fixing unit 5 by a conveying belt 42, and the toner image is fixed to the front surface of the sheet material S by thermally compressing the toner image by the heat fixing unit 5 so as to fix a full color image. Thereafter, the sheet material S is fed out to a copy receiving tray 65 through a paper ejection conveying path 82.

The toner remaining on the intermediate transfer belt 31 without being used during the secondary transfer is collected by an intermediate transfer member cleaning apparatus 36.

A further detailed description will now be given of the intermediate transfer member cleaning apparatus 36 adapted to clean the intermediate transfer member serving as the second image bearing member, which is an embodiment of the present invention.

Figure 2:
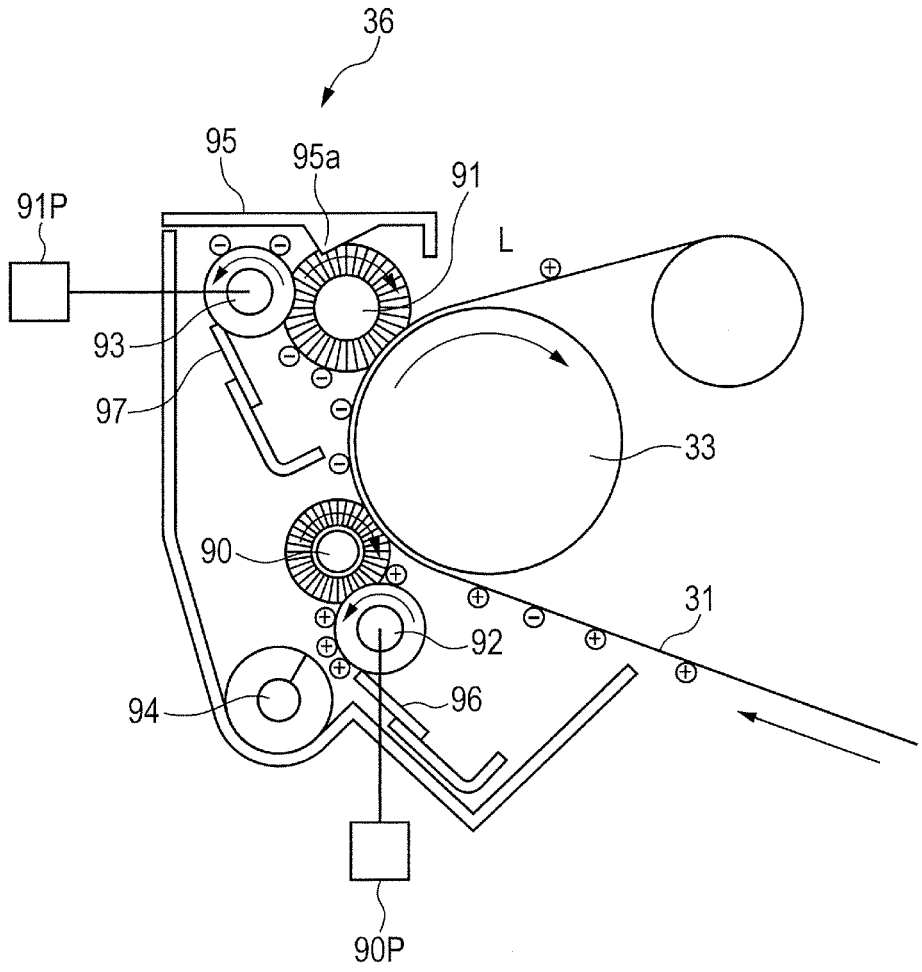
FIG. 2 is a schematic diagram of a cleaning apparatus according to an embodiment of the present invention.

FIG. 2 is a schematic configuration sectional view illustrating an exemplary embodiment of the intermediate transfer member cleaning apparatus 36 in accordance with the present invention.

In the present embodiment, the intermediate transfer member cleaning apparatus 36 is provided with, as cleaning members, a first fur brush 90 disposed on the upstream side relative to the direction in which the intermediate transfer belt 31 rotationally moves and a second fur brush 91 disposed on the downstream side. The fur brushes 90 and 91 are provided such that they are in contact with the intermediate transfer belt 31 and rotate in a counter direction (in the opposite direction at the contact positions). Biases of different polarities are applied to the fur brushes 90 and 91 from individual power sources 90P and 91P, respectively, through the intermediary of bias rollers 92 and 93. These fur brushes 90 and 91 and the bias rollers 92 and 93 are supported by a cleaning container 95 constituting the cleaning apparatus 36.

The bias rollers 92 and 93 are disposed such that they rotate in a forward direction while in contact with the fur brushes 90 and 91 (in the same direction at the contact positions). In the present embodiment, a negative voltage is applied from the power source 90P to the bias roller 92 on the upstream side in the direction in which the intermediate transfer belt 31 rotationally moves, while a positive voltage is applied from the power source 91P to the bias roller 93 on the downstream side.

The transfer residual toners which have passed the secondary transfer section $T_2$ are mainly charged to the positive polarity. As the intermediate transfer belt 31 rotates in the direction of the arrow, the surface of the intermediate transfer belt 31 is electrostatically cleaned by using the first fur brush 90 under the application of a negative bias. For example, if −3.5 kV is applied to the bias roller 92, then the first fur brush 90 will have −2.0 kV, causing the positive transfer residual toners on the intermediate transfer belt 31, which is the second image bearing member, to be transferred toward the fur brush 90 (onto the fur brush). The toners transferred onto the fur brush 90 are further transferred onto the bias roller 92 from the fur brush 90 by making use of a potential difference. The leading edge of a cleaning blade 96 is pressed against the bias roller 92 to scrape the transferred toner from the bias roller 92.

Although the toners on the intermediate transfer belt 31 are removed by the first fur brush 90, the transfer residual toners are still on the intermediate transfer belt 31. The toners are charged to the negative polarity by a negative bias applied to the first fur brush 90. The charging is considered to be implemented by charge injection or discharge.

Then, the second fur brush 91 is used to carry out the cleaning under the application of a positive bias. This makes it possible to remove the transfer residual toners that could not be removed by the fur brush 90. The removed toners are transferred from the fur brush 91 to the bias roller 93 by making use of the potential difference. The leading edge of a cleaning blade 97 is pressed against the bias roller 93 to scrape the transferred toners from the bias roller 93.

The toners scraped off by the blades 96 and 97 are carried by a toner collecting screw 94 and collected into a waste toner tank (not shown). Alternatively, a toner recycling device (not shown) may be used to return the collected toners to the developing units 14.

Most transfer residual toners on the intermediate transfer belt 31 are removed by the cleaning with the second fur brush 91. However, there is a case where a slight amount of toners still remains on the intermediate transfer belt 31. The transfer residual toners have been positively charged by the positive bias applied to the fur brush 91. The transfer residual toner can be reversely transferred to the photosensitive drum 11Y at the primary transfer position of yellow and collected by the photosensitive cleaning apparatus 15Y.

Further, in addition to standard image formation, a patch pattern is used in some cases. In such a case, a toner for a patch image (a patch toner) reaching the intermediate transfer member cleaning apparatus 36 is negatively charged, because it is not subjected to the application of a voltage at the secondary transfer section $T_2$. Hence, the toner is not removed by the first fur brush 90, and the patch toner will be removed by the second fur brush 91.

The configurations of the cleaning brushes 90 and 91 in the intermediate transfer member cleaning apparatus 36 according to the present invention will now be described in detail.

Figure 6:
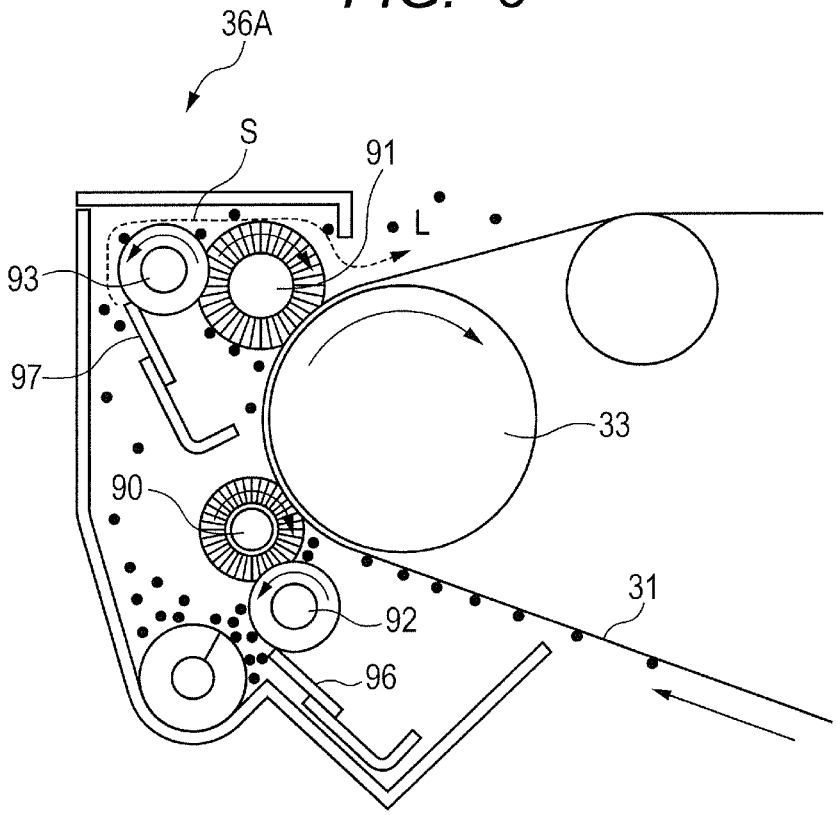
FIG. 6 is a schematic configuration diagram of a conventional cleaning apparatus.
Figure 7A:
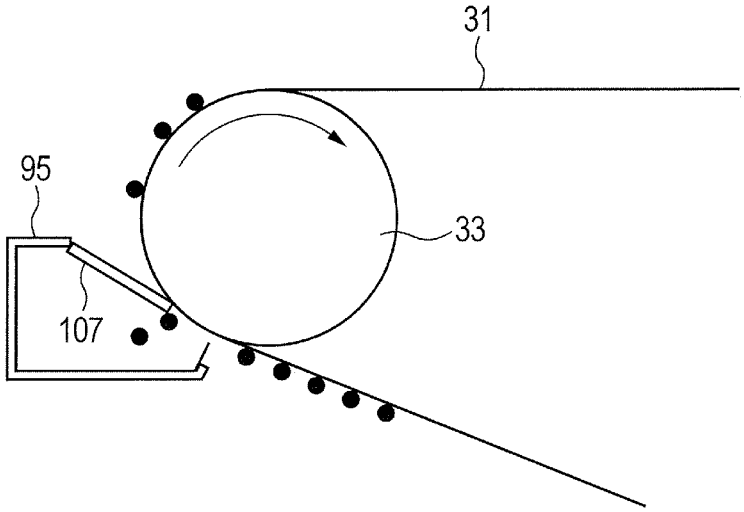
FIGS. 7A and 7B are schematic configuration diagrams of conventional cleaning apparatuses.
Figure 7B:
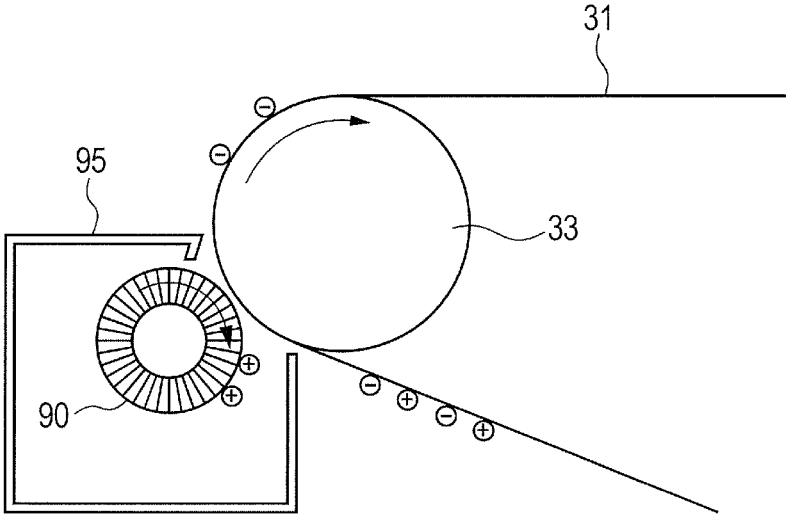

FIG. 6 is a schematic configuration sectional view of a conventional intermediate transfer member cleaning apparatus 36A.

In the operation for cleaning off toners on a conventional intermediate transfer belt 31, toners have been scattered at the portion of contact between a second fur brush 91 and a bias roller 93 and the portion of contact between a blade 97 and the bias roller 93. The scattering toners produced flow out into a space L outside the cleaning apparatus along the scattering toner outflow path shown in FIG. 6 due to the air flow caused by the rotations of the fur brush 91 and the intermediate transfer belt 31. The outflow of the scattering toners into the space L outside the cleaning apparatus has been dirtying the interior of the image forming apparatus 100, resulting in a deteriorated image.

Figure 3A:
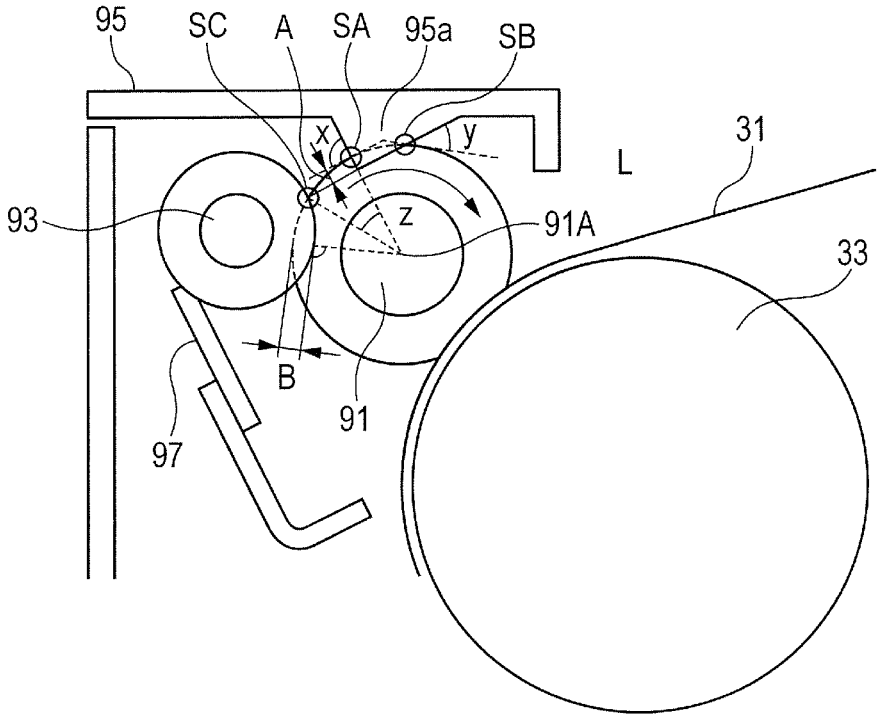
FIGS. 3A and 3B are enlarged views of an anti-scatter portion of the cleaning apparatus in accordance with the present invention.
Figure 3B:
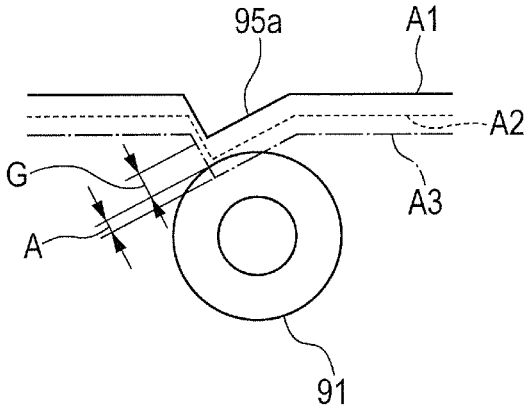

According to the present invention, therefore, the cleaning container 95 of the cleaning apparatus 36 is provided with a projecting anti-scatter portion 95*a* such that the anti-scatter portion 95*a* is disposed to enter into the fur brush 91, blocking the bias roller 93 from the space L outside the cleaning apparatus, as illustrated in FIGS. 2, 3A and 3B. This prevents the scattering toners from flowing out into an image forming apparatus 100.

Figure 4A:
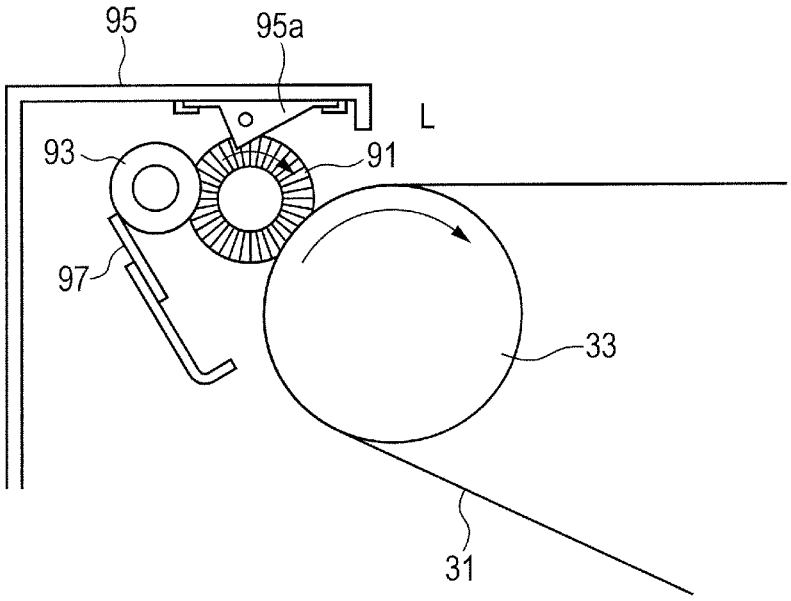
FIGS. 4A and 4B illustrate another embodiment of the cleaning apparatus in accordance with the present invention.
Figure 4B:
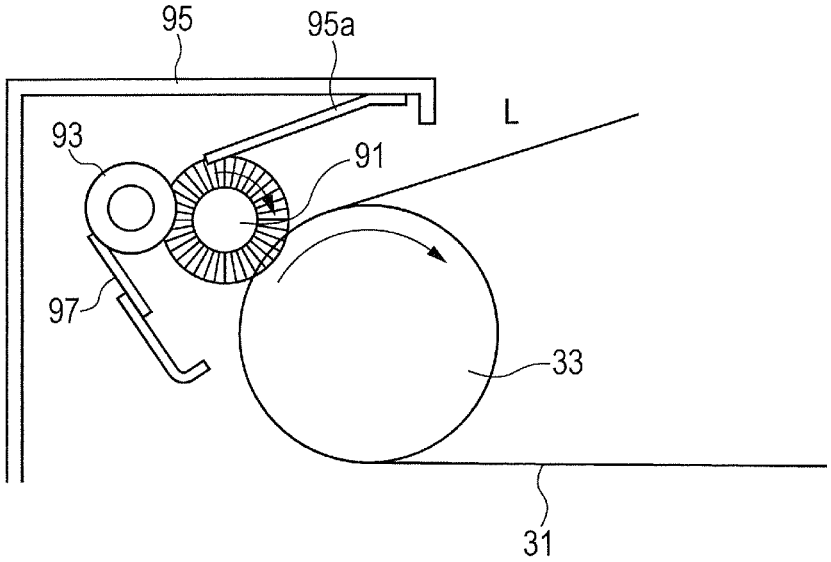

In the present embodiment, the anti-scatter portion 95*a* is formed as an integral part of the cleaning container 95. Alternatively, however, the anti-scatter portion 95*a* may be formed as a separate member detachable with respect to the cleaning container 95, as illustrated in FIG. 4A. Further, as illustrated in FIG. 4B, the anti-scatter portion 95*a* may be formed to be a sheet-like member to be attached to the cleaning container 95 such that the anti-scatter portion 95*a* enters into the fur brush 91.

Referring now to FIGS. 3A and 3B, the amount of the entry of the anti-scatter portion 95*a* into the fur brush 91 will be described. The relationship between an amount A of the entry of the anti-scatter portion 95*a* into the fur brush 91 and an amount B of the entry of the bias roller 93 thereinto is desirably as follows.

(Entry amount A of the anti-scatter portion 95a)<(Entry amount B of the bias roller 93)

For example, the entry amount A is set to 1.0 mm, while the entry amount B is set to 2.0 mm.

If the above relationship is not satisfied, then the following phenomenon will occur if the entry amount B of the bias roller 93 is smaller than the entry amount A of the anti-scatter portion 95*a*.

The toner that has not been collected by the bias roller 93 and still remains at the root of the hair of the fur brush 91 is flicked off by the hair raising effect of the anti-scatter portion 95*a*. This causes the toner to flow out into the space L outside the cleaning apparatus. For this reason, the entry amount relationship is preferably set to A<B as described above.

The description will now be given of the position of the entry of the anti-scatter portion 95*a*.

In the present embodiment, the entry position of the anti-scatter portion 95*a* is set to a point immediately after the downstream side in the rotational direction of the fur brush 91 with respect to the portion of contact between the bias roller 93 and the fur brush 91. At this position, an angle z in FIG. 3A, which is a schematic diagram on a plane perpendicular to the axis of rotation of the fur brush 91, is an acute angle. The angle z is formed by the segments that connect an entering start point SA of the anti-scatter portion 95*a*, a center of rotation 91A of the fur brush 91, and an entry end point SC of the bias roller 93. The angle z is formed on the side where the fur brush 91 is not in contact with the intermediate transfer belt 31.

The entry position is set such that the angle z becomes an acute angle, thereby minimizing the area of the surface of the fur brush 91 to which the scattering toner in the cleaning apparatus 36 adheres. This arrangement prevents the scattering toner in the cleaning apparatus 36, which toner adheres again to the fur brush 91 that has been cleaned by the bias roller 93 removing the toner, from being flicked out into the space L outside the cleaning apparatus. This arrangement makes it possible to ensure that the fur brush 91 is clean when brought in contact with the intermediate transfer belt 31 to clean the intermediate transfer belt 31.

Referring now to FIG. 3A, the external configuration of the entering portion of the anti-scatter portion 95*a* will be described.

The angle formed by the surface of the anti-scatter portion 95*a* that is adjacent to the intermediate transfer belt 31 (the second image bearing member) and the tangent line on the outer circumference of the fur brush 91 at an entry end point SB of the anti-scatter portion 95*a* is denoted by y. The entering portion of the anti-scatter portion 95*a* is shaped such that the angle y at the entry end point SB of the anti-scatter portion 95*a* is minimized to prevent the scattering toner, which has adhered to the fur brush 91 again, from being flicked into the space L outside the cleaning apparatus. The shape with the minimized angle y causes the hair to slowly rise after being pressed down, thus providing the effect for restraining the toner from being flicked.

Further, the angle formed by the tangent line on the outer circumference of the fur brush 91 at an entry start point SA of the anti-scatter portion 95*a* and the surface of the anti-scatter portion 95*a* that is adjacent to the bias roller is denoted by x. The angle x at the entry start point of the anti-scatter portion 95*a* is set to be larger. This makes it possible to reduce the area of contact between the fur brush 91 and the anti-scatter portion 95*a*, consequently reducing the damage on the fur attributable to friction.

The description will now be given of a width (G) of the gap at the contact between the anti-scatter portion 95*a* and the fur brush 91, i.e., the amount of entry.

As illustrated in FIG. 3B, experiments have been conducted under the following three conditions on the width G of the gap at the contact between the anti-scatter portion 95*a* and the fur brush 91.

The experiments were conducted under difference relationships between the anti-scatter portion 95*a* and the fur brush 91 by changing the gap. Referring to FIG. 3B, A1 indicates the gap G set to 1 mm, A2 indicates the gap G set to 0 mm, and A3 indicates the gap G set to −1 mm (the amount of entry A=1 mm). The gap G set to −1 mm, i.e., the amount of entry A set to 1 mm, applies to the configuration according to the present invention.

Table 1 shows the results of the experiments on the amount of scattering toner carried out under the aforesaid conditions. For the purpose of measurement, a particle size distribution measuring instrument was used to count the quantity of particles corresponding to the toner particle size.

TABLE 1

| Relationship between anti-scatter portion and fur brush | Quantity of scattering toner particles (pcs/s) | Evaluation |
|---|---|---|
| (A1) gap (G) = 1 mm | 4562.7 | FAIL |
| (A2) gap (G) = 0 mm | 1384.2 | FAIL |
| (A3) gap (G) = −1 mm (Amount of entry A = 1 mm) | 0.3 | PASS |

According to the experiment results, it has been verified that the toner flows out even when the anti-scatter portion 95*a* is disposed relative to the fur brush 91 such that the gap G becomes 0 mm, indicating that the slight contact still causes the toner to slip through the gaps in the hair of the fur brush. Meanwhile, in the case where the anti-scatter portion 95*a* is disposed with the gap (G) set to −1 mm, i.e., the amount of entry A set to 1 mm, which is the configuration according to the present invention, the result of the measurement of the scattering toner indicates substantially zero, meaning that the outflow of the scattering toner is completely prevented.

Further, the present invention has proven to provide the effect for restraining the temporal change in the outer diameter of the fur brush 91 in addition to the effect for preventing the scattering toners from flowing out into the space L outside the cleaning apparatus 36.

Figure 5:
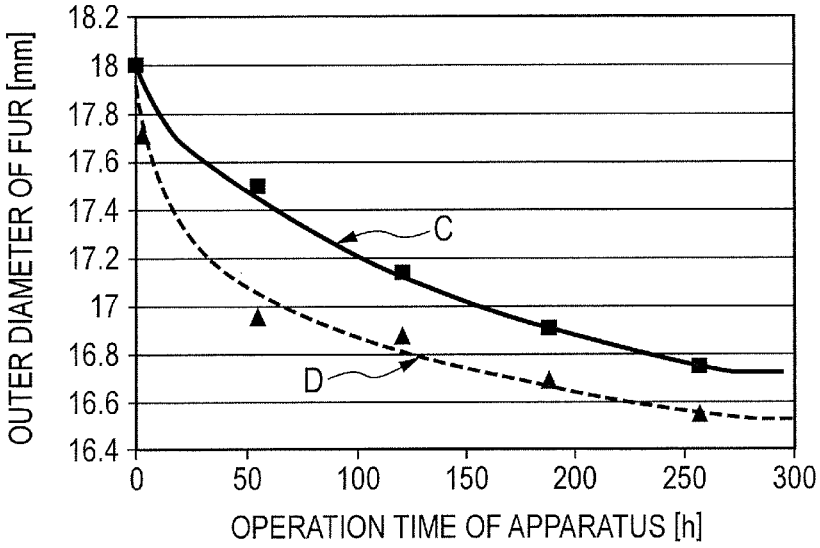
FIG. 5 is a graph indicating the results of experiments on the operation time of the cleaning apparatus versus changes in the outer diameter of the fur brush in the case where the anti-scatter portion of the cleaning apparatus according to the present invention enters into the fur brush and the case where the anti-scatter portion does not enter into the fur brush.

FIG. 5 is a graph illustrating the results of the experiments on the temporal changes in the outer diameter of the fur brush 91. In the graph, C denotes the case where an entering portion (the amount of entry A=1 mm) is provided, while D denotes the case where the entering portion is not provided.

The experiment results indicate that, whether the anti-scatter portion 95*a* has the entering portion or not, the outer diameter of the fur brush 91 decreases due to the hair flattening effect of the bias roller 93, which is rotationally driven with respect to the fur brush 91. However, the amount of the temporal change in the outer diameter with respect to the operation time of the cleaning apparatus 36 in the case where the entering portion (the amount of entry A=1 mm) is provided is smaller than that in the case where the entering portion is not provided. This indicates that the entering portion has the effect for raising the hair of the fur brush 91, thus restraining the deterioration in the cleaning capability of the fur brush 91.

In the present embodiment, the description has been given of the intermediate transfer member cleaning apparatus, taking the intermediate transfer belt serving as the image bearing member that carries toners as an example; however, the cleaning apparatus according to the present invention is not limited thereto. A cleaning apparatus having the same configuration can be applied for cleaning a drum type intermediate transfer member or photosensitive member. Further, although the description has been given of the cleaning apparatus in a color image forming apparatus, the cleaning apparatus having the same configuration can be used also for a monochromatic image forming apparatus. The image forming apparatuses in modified forms are known to one skilled in the art, so that no detailed description will be given.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-100344, filed Apr. 25, 2012, which is hereby incorporated by reference herein in its entirety.

What is claimed is:

1. A cleaning apparatus, comprising:

a fur brush configured to contact with an image bearing member at a first contact position and electrostatically collect a toner on the image bearing member, and to rotate in an opposite direction with respect to a moving direction of the image bearing member at the first contact position;

a bias roller configured to enter into the fur brush at a second contact position, and electrostatically collect the toner on the fur brush, and to rotate in the same direction with respect to a moving direction of the fur brush at the second contact position; and a cleaning container configured to support the fur brush and the bias roller, and to have an anti-scatter portion, which enters into the fur brush so as to shield the bias roller from an outside of the cleaning apparatus, wherein an amount of entry of the anti-scatter portion into the fur brush is smaller than an amount of entry of the bias roller into the fur brush.

2. The cleaning apparatus according to claim 1, wherein the anti-scatter portion is formed integrally with the cleaning container.

3. The cleaning apparatus according to claim 1, wherein the anti-scatter portion is formed of a member that is separate from the cleaning container and attached to the cleaning container.

4. An image forming apparatus comprising the cleaning apparatus according to claim 1, wherein the image bearing member is an intermediate transfer member carrying a toner image.

5. An image forming apparatus comprising the cleaning apparatus according to claim 1, wherein the image bearing member is a photosensitive member carrying a toner image.

6. A cleaning apparatus, comprising:

a fur brush configured to contact with an image bearing member at a first contact position and electrostatically collect a toner on the image bearing member, and to rotate in an opposite direction with respect to a moving direction of the image bearing member at the first contact position;

a bias roller configured to enter into the fur brush at a second contact position, and electrostatically collect the toner on the fur brush, and to rotate in the same direction with respect to a moving direction of the fur brush at the second contact position; and a cleaning container configured to support the fur brush and the bias roller, and to have an anti-scatter portion, which enters into the fur brush so as to shield the bias roller from an outside of the cleaning apparatus, wherein an entering portion of the anti-scatter portion with respect to the fur brush is positioned immediately after a downstream side in a direction of rotation of the fur brush in relation to a portion of contact between the bias roller and the fur brush, and wherein in a plane perpendicular to an axis of rotation of the fur brush, when a first segment is a segment that connects a start point of the anti-scatter portion entering into the fur brush as the fur brush rotates and a center of rotation of the fur brush, and a second segment is a segment that connects an end point of the bias roller entering into the fur brush as the fur brush rotates and the center of rotation of the fur brush, an angle formed between the first segment and the second segment on a side where the fur brush is not in contact with the image bearing member is an acute angle.

7. The cleaning apparatus according to claim 6, wherein the anti-scatter portion is formed integrally with the cleaning container.

8. The cleaning apparatus according to claim 6, wherein the anti-scatter portion is formed of a member that is separate from the cleaning container and attached to the cleaning container.

9. An image forming apparatus comprising the cleaning apparatus according to claim 6, wherein the image bearing member is an intermediate transfer member carrying a toner image.

10. An image forming apparatus comprising the cleaning apparatus according to claim 6, wherein the image bearing member is a photosensitive member carrying a toner image.

11. A cleaning apparatus, comprising:

a fur brush configured to contact with an image bearing member at a first contact position and electrostatically collect a toner on the image bearing member, and to rotate in an opposite direction with respect to a moving direction of the image bearing member at the first contact position;

a bias roller configured to enter into the fur brush at a second contact position, and electrostatically collect the toner on the fur brush, and to rotate in the same direction with respect to a moving direction of the fur brush at the second contact position; and a cleaning container configured to support the fur brush and the bias roller, and to have an anti-scatter portion, which enters into the fur brush so as to shield the bias roller from an outside of the cleaning apparatus, wherein an entering portion of the anti-scatter portion with respect to the fur brush is positioned immediately after a downstream side in a direction of rotation of the fur brush in relation to a portion of contact between the bias roller and the fur brush, and wherein in a plane perpendicular to an axis of rotation of the fur brush, an angle formed by a tangent line on an outer circumference of the fur brush at a start point of the entering portion of the anti-scatter portion with respect to the fur brush and a line formed by a surface of the anti-scatter portion that is adjacent to the bias roller is larger than an angle formed by a tangent line on the outer circumference of the fur brush at an end point of the entering portion of the anti-scatter portion with respect to the fur brush and a line formed by the surface of the anti-scatter portion that is adjacent to the image bearing member.

12. The cleaning apparatus according to claim 11, wherein the anti-scatter portion is formed integrally with the cleaning container.

13. The cleaning apparatus according to claim 11, wherein the anti-scatter portion is formed of a member that is separate from the cleaning container and attached to the cleaning container.

14. An image forming apparatus comprising the cleaning apparatus according to claim 11, wherein the image bearing member is an intermediate transfer member carrying a toner image.

15. An image forming apparatus comprising the cleaning apparatus according to claim 11, wherein the image bearing member is a photosensitive member carrying a toner image.

* * * * *